United States Patent [19]

Edwards et al.

[11] Patent Number: 4,938,285

[45] Date of Patent: Jul. 3, 1990

[54] ULTRA-HIGH MOLECULAR WEIGHT POLYETHYLENE SUCKER ROD GUIDE

[76] Inventors: Billy J. Edwards, 1917 Cambridge, Bossier City, La. 71112; Jimmy A. Starks, 1105 James, Bossier City, La. 71111

[21] Appl. No.: 357,794

[22] Filed: May 30, 1989

Related U.S. Application Data

[63] Continuation-in-part of Ser. No. 211,567, Jun. 27, 1988, Pat. No. 4,858,688.

[51] Int. Cl.[5] ..... E21B 17/10

[52] U.S. Cl. ..... 166/241; 175/325

[58] Field of Search ..... 166/241, 242, 176; 175/325

[56] References Cited

U.S. PATENT DOCUMENTS

| | | | |
|---|---|---|---|
| Re. 31,016 | 8/1982 | Oster | 166/241 |
| 2,299,978 | 10/1942 | Hall | 175/325 |
| 2,793,917 | 5/1957 | Ward | 166/176 |
| 2,897,016 | 7/1959 | Baker | 175/325 |
| 3,320,004 | 5/1967 | Garrett | 175/325 |
| 3,442,558 | 5/1969 | Sable | 175/325 |
| 3,516,494 | 6/1970 | Ward | 166/176 |
| 3,864,182 | 2/1975 | Shobert et al. | 166/231 |
| 3,889,579 | 6/1975 | Wiechowski et al. | 166/68 |
| 4,575,163 | 3/1986 | Sable | 166/241 |

*Primary Examiner*—Jerome W. Massie, IV
*Assistant Examiner*—Terry Lee Melius
*Attorney, Agent, or Firm*—John M. Harrison

[57] ABSTRACT

An ultra-high molecular weight polyethylene sucker rod guide for mounting on a sucker rod in multiple, spaced units and preventing, or at least minimizing, contact between the sucker rod and the tubing which encloses the sucker rod. In a preferred embodiment the sucker rod guide is characterized by an extruded polyethylene plastic having an ultra-high molecular weight and ultra-high density which exhibits a wet coefficient of friction that is lower than that of metal, to increase the overall pumping efficiency of oil wells. In a most preferred embodiment of the invention, the sucker rod guide is constructed of a self-lubricating, ultra-high molecular weight, ultra-high density, extruded polyethylene bar stock. The sucker rod guide includes a longitudinal, grooved bore which is preferably undersized with respect to the sucker rod upon which the sucker rod guide is mounted and a tapered body slot which communicates with the bore for inserting the sucker rod guide on a sucker rod at a desired location. Multiple units of the sucker rod guide are attached to the sucker rod string in spaced relationship, in order to radially space the sucker rod string from the tubing, lubricate the reciprocating or spinning action of the sucker rod string and prevent or minimize sucker rod and tubing wear. Various sucker rod guides constructed according to this invention are color-coded according to size for quick identification and installation on sucker rods of various diameter.

5 Claims, 1 Drawing Sheet

ULTRA-HIGH MOLECULAR WEIGHT POLYETHYLENE SUCKER ROD GUIDE

CROSS-REFERENCE TO RELATED APPLICATIONS

This application is a continuation-in-part of our copending U.S. patent application Ser. No. 07/211,567, filed June 27, 1988 now U.S. Pat. No. 4,858,688.

BACKGROUND OF THE INVENTION

FIELD OF THE INVENTION

This invention relates to production equipment for oil wells and more particularly, to sucker rod guides for mounting in spaced relationship on the sucker rod string of a pumping well. The sucker rod guides of this invention may be color-coded for size identification and are each characterized by a generally cylindrically-shaped, smooth guide body having tapered top and bottom portions and a longitudinal, grooved bore which is preferably slightly undersized with respect to the sucker rod to which the sucker rod guides are attached. A tapered, inwardly expanding, longitudinal body slot extends longitudinally through the entire guide body of the sucker rod guide and communicates with the longitudinal bore, in order to provide a means for mounting one or more sucker rod guides on a sucker rod at a specific location or locations. In a preferred embodiment, the sucker rod guide of this invention is constructed by extruding a molten, self-lubricating plastic such as polyethylene, having an ultra-high molecular weight and density through a die to define a slotted cylinder having a smooth bore and a tapered longitudinal slot. Grooves may then be added to the bore by using a reaming tool to facilitate a more firm attachment to the sucker rod. Alternatively, the extruded, slotted cylinder can be centrally drilled to provide the longitudinal bore and the spaced grooves.

It has surprisingly been found that extruded molten polyethylene having an ultra-high molecular weight and corresponding ultra-high density produces a sucker rod guide that yields highly favorable abrasion and lubricating qualities, as well as a high tensile strength and a relatively high coefficient of thermal expansion, and other physical properties which are far superior to that of conventional sucker rod guides. In fact, it has been found by analysis and testing that extruded polyethylene plastic bar stock having a molecular weight in the range of approximately two million to six million, accounts for the superior physical characteristics of the extruded polyethylene. It has also been found that the polyethylene sucker rod guides of this invention are not adversely affected by hydrogen sulfide, salt water and other corrosive fluids and compounds normally found in an oil well.

Sucker rod guides of various description and composition are designed to fit on sucker rods used to pump oil wells, in order to eliminate, or at least greatly reduce, many of the down-hole problems which are characteristic of production equipment in oil wells. Because the ultra-high molecular weight, ultra-high density plastic sucker rod guides of this invention are generally characterized by a wet coefficient of friction which is lower than that of metal, they operate to increase the overall pumping efficiency of the wells, while at the same time prevent undesirable metal-to-metal contact between the reciprocating or spinning rods and the stationary tubing. Wear on sucker rod couplings used to make up the down-hole sucker rod string is also minimized, thus reducing the required inventory of costly rod parts. Tubing wear, often unseen until failure occurs, is also reduced, because the sucker rod guides receive the wear rather than the expensive tubing. The sucker rod guides of this invention also function as bearings to centralize the sucker rods in the tubing and even when the tubing buckles in a well during downstroke of the pumping unit, the sucker rods cannot contact the tubing due to the spaced positioning of the sucker rod guides on the sucker rods. Polish rod loads are also reduced because of the lower friction and less abrupt "stress reverse" which is realized when using the highly efficient sucker rod guides detailed herein. Accordingly, a properly designed sucker rod installation using the ultra-high molecular weight and, ultra-high density polyethylene sucker rod guides of this invention can realize significant savings in both equipment replacement and service costs in a pumping oil well. Fewer "pulling jobs", greater pumping efficiency and wells that stay in the pumping mode for longer periods of time, are proven results obtained from the use of the specially designed sucker rod guides of this invention.

Sucker rod guides of various design, size and materials of construction are well known in the art. Among the typical materials of construction are neoprene rubber and nylon and these materials are commonly used with metal inserts which encase and line the sucker rod guide bore, in order to facilitate better gripping of the sucker rod by the sucker rod guide and maintaining the sucker rod guide in a selected position on the sucker rod. However, it has been found that friction generated between the neoprene rubber sucker rod guides and the tubing as the sucker rod guide reciprocates or spins with the sucker rod string inside the tubing sometimes generates heat, which may result in a rapid deterioration of the neoprene material, thereby necessitating frequent "pulling jobs" in order to replace the guides. Furthermore, it has been found that nylon sucker rod guides are brittle and sometimes difficult to mount on a sucker rod without breaking, especially in cold weather. Sucker rod guides are typically secured to the respective lengths of sucker rod in spaced relationship, in order to space the sucker rod string from the tubing and protect both the sucker rod, sucker rod couplings and the tubing from excessive wear during the pumping operation. Since the reciprocating travel of each reciprocating sucker rod and sucker rod guide may be from approximately 3 feet to about 20 feet or more and this travel occurs at a rate of about 15 strokes per minute on the average, the material used to shape the sucker rod guide should be self-lubricating or easily lubricated by the well fluid and must have superior wear characteristics, in order to minimize the frequency of maintenance. Each sucker rod guide should also remain in the installed position on the sucker rod since the spacing of the guides prevents the sucker rod from contacting and damaging the tubing.

Accordingly, it is an object of this invention to provide a new and improved extruded plastic sucker rod guide having an ultra-high molecular weight, for mounting on the sucker rod of an oil well and preventing, or at least minimizing, metal-to-metal contact between the sucker rod and the tubing.

Another object of this invention is to provide a new and improved, injection-molded or compression molded, ultra-high density polyethylene sucker rod guide which is characterized by an exceptionally high abrasive resistance and good self-lubricating characteristics and is designed to tightly seat on the sucker rod of a pumping well at a specific location, with little or no displacement from the point of installation, to space the sucker rod from the tubing.

Still another object of the invention is to provide a sucker rod guide which is constructed of extruded polyethylene having an ultra-high molecular weight of at least 2 million for mounting on the sucker rod of a pumping unit in an oil well, which sucker rod guide includes a generally cylindrically-shaped body having a longitudinal, smooth or grooved sucker rod bore that is slightly undersized with respect to the sucker rod to which it is attached and further including an inwardly-expanding, tapered body slot extending longitudinally through the sucker rod guide body and communicating with the sucker rod bore, to facilitate mounting the sucker rod guide on the sucker rod.

Yet another object of the invention is to provide an extruded, ultra-high density polyethylene sucker rod guide having an ultra-high molecular weight in the range of from about 2 million to about six million and characterized by superior resistance to impact, wear, cracking, abrasion and corrosion, a high tensile strength, a relatively high coefficient of thermal expansion and a low coefficient of friction.

A still further object of this invention is to provide a generally cylindrically-shaped, extruded, ultra-high molecular weight and ultra-high density polyethylene sucker rod guide provided with a longitudinal, circumferentially grooved sucker rod bore which is slightly undersized with respect to the sucker rod to which the guide is attached, and a longitudinal, tapered slot extending through the sucker rod guide body and communicating with the sucker rod bore, for mounting the sucker rod guide on the sucker rod.

SUMMARY OF THE INVENTION

These and other objects of the invention are provided in a new and improved sucker rod guide for mounting on a sucker rod in a reciprocating or spinning sucker rod oil well pumping unit, which sucker rod guide is characterized by an extruded, substantially self-lubricating, ultra-high molecular weight polyethylene guide body having an ultra-high density. The guide body includes a top and bottom taper and a circumferentially grooved sucker rod bore extending longitudinally therethrough, which bore is slightly undersized with respect to the sucker rod to which it is attached. Further included is an inwardly-expanding, tapered slot extending longitudinally through the sucker rod guide body and communicating with the sucker rod bore, for mounting the sucker rod guide on the sucker rod and insuring that the sucker rod guide is maintained approximately at the point of installation on the sucker rod during operation of the pumping unit. In a preferred embodiment, the degree of undersize of the sucker rod bore and the degree of taper provided in the tapered slot are chosen such that the slot walls are approximately parallel to each other when the sucker rod guide is mounted on a sucker rod.

BRIEF DESCRIPTION OF THE DRAWING

The invention will be better understood by reference to the accompanying drawing, wherein.

DESCRIPTION OF THE PREFERRED EMBODIMENTS

Figure 1:
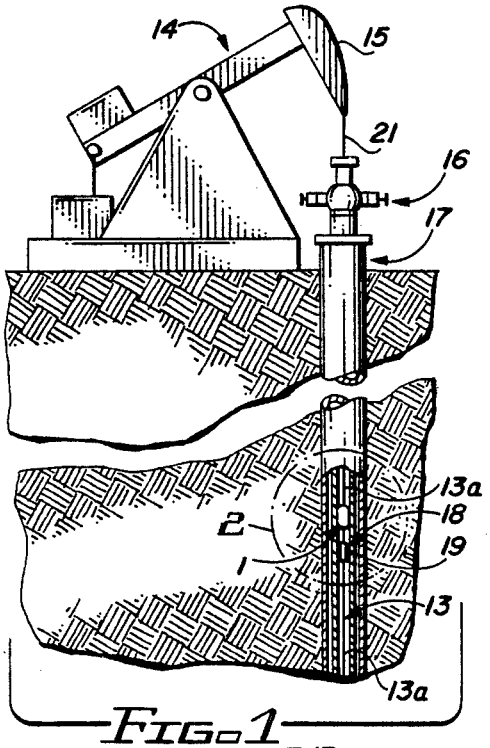
FIG. 1 is a side elevation, partially in section, of a typical reciprocating unit and related production equipment for an oil well.
Figure 3:
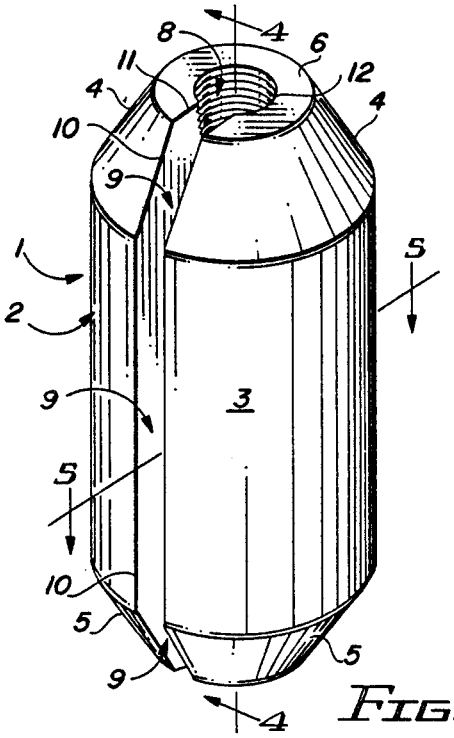
FIG. 3 is a perspective view of a preferred embodiment of an unmounted sucker rod guide of this invention.
Figure 2:
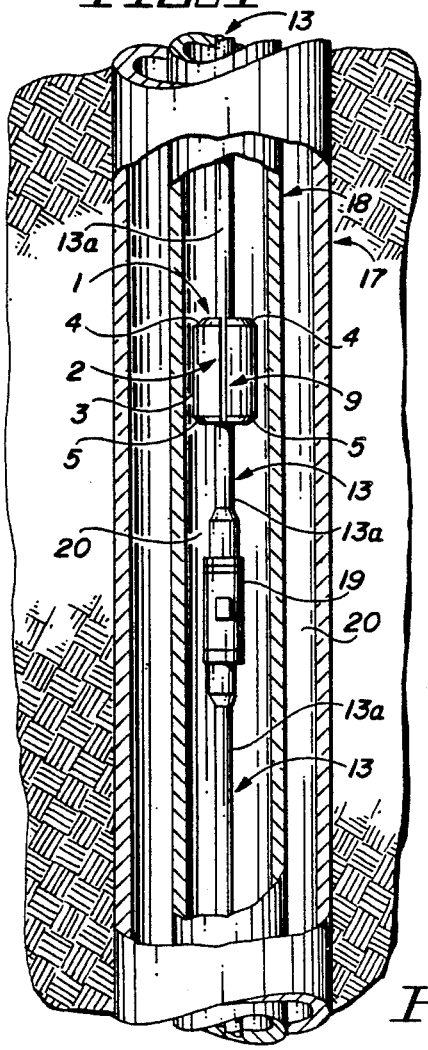
FIG. 2 is an enlarged sectional view of a length of casing and tubing illustrated in FIG. 1, with a sucker rod reciprocating inside the tubing and a sucker rod on the sucker rod.

Referring initially to FIGS. 1–3 of the drawing, a conventional pumping unit is generally illustrated by reference numeral 14 and is fitted with a horsehead 15, for reciprocating a polish rod 21 in a well head 16 and a connecting sucker rod string 13 inside a length of tubing 18, which is concentrically enclosed in a casing 17. The horsehead 15 is located above the well head 16 and the sucker rod string 13 extends downwardly from the polish rod 21 through the tubing 18 to a down-hole pump (not illustrated). The down-hole pump is designed to pump production fluid upwardly through a production annulus 20 located inside the tubing 18, as illustrated in FIG. 2. The sucker rod string 13 includes multiple lengths of elongated sucker rods **13*a*, which are joined at the sucker rod couplings 19**, in order to locate the down-hole pump (not illustrated) at a selected producing interval location (not illustrated) in the well.

Multiple units of the sucker rod guide 1 of this invention are located in spaced relationship on each of the sucker rods **13*a*, preferably at points near the sucker rod couplings 19, in order to radially space the sucker rods 13*a* and sucker rod couplings 19 from the inside wall of the tubing 18 during reciprocation of the sucker rod string 13 pursuant to operation of the pumping unit 14. As illustrated in FIG. 3, each sucker rod guide 1 is characterized by an extruded polyethylene guide body 2 having an ultra-high molecular weight and constructed to define a generally cylindrically-shaped, smooth center body section 3, which is terminated at one end by a top taper 4 and a flat top margin 6 and at the opposite end by a bottom taper 5 and a corresponding flat bottom margin 7. A sucker rod bore 8 is provided longitudinally through the center of the guide body 2 and in a preferred embodiment of the invention, the sucker rod bore 8 is slightly undersized and most preferably, about 1/16 of an inch undersized, with respect to the sucker rod 13*a* to which the sucker rod guide 1 is attached. The sucker rod bore 8 may be smooth. However, in another preferred embodiment of the invention, multiple circumferential grooves 12 are provided in the sucker rod bore 8, in order to help maintain each sucker rod guide 1 tightly on a companion sucker rod 13*a* in a selected location, in spite of contact between the guide body 2 and the inside surface of the tubing 18 during reciprocation or spinning of the sucker rod string 13. An inwardly-expanding, tapered body slot 9 is provided in the guide body 2 of the sucker rod guide 1 and the body slot 9 extends longitudinally from the top margin 6**, completely through the guide body 2 and through the bottom taper 5 and bottom margin 7 and communicates with the sucker rod bore 8, as illustrated in FIG. 3.

Figure 5:
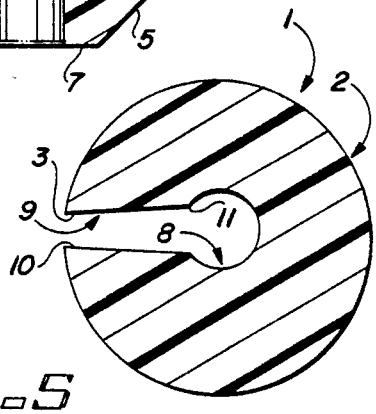
FIG. 5 is a traverse sectional view taken along line 5—5 of the sucker rod guide illustrated in FIG. 3.

As illustrated in FIGS. 3 and 5, in a most preferred embodiment of the invention, when the sucker rod guide 1 is not installed on a sucker rod 13*a*, the body slot 9 is tapered in expanding relationship from a slot mouth 10 to a slot throat 11, such that the body slot 9 is wider at the slot throat 11 than at the slot mouth 10. Accordingly, this feature, in combination with the undersizing of the sucker rod bore 8 with respect to the sucker rod 13*a* to which the sucker rod guide 1 is attached, serves to effect a spring-like action in the sucker rod guide 1, to more tightly mount each sucker rod guide 1 on the companion sucker rod 13*a*. When the sucker rod guide 1 is installed on a sucker rod 13*a*, the slot mouth 10 is expanded and the spaced sides of the body slot 9 are approximately parallel, since the slot mouth 10 is then substantially equal to or greater than the width of the slot throat 11. It has been found that this configuration of the body slot 9, in combination with the undersizing of the sucker rod bore 8, serves to help maintain each sucker rod guide 1 substantially in the desired installed location on a companion sucker rod 13*a*, despite the reciprocating or spinning action of the sucker rod string 13 with accompanying frequent contact between the center body section 3 of the sucker rod guide 1 and the inside surface of the tubing 18.

In a most preferred embodiment, the sucker rod guide 1 of this invention is characterized by an extruded polyethylene bar stock which is characterized by an ultra-high molecular weight with accompanying ultra-high density and excellent self-lubricating and/or wet-lubricating characteristics. For example, it has been found that such excellent lubricating qualities, as well as other superior physical properties, such as high tensile strength, high coefficient of expansion, low coefficient of friction and excellent resistance to impact, stress cracking, corrosion and abrasion of the round extruded polyethylene bar stock used to fabricate the sucker rod guide 1, results from an ultra-high molecular weight of at least about two million, which ultra-high molecular weight results in an ultra-high density and accompanying physical properties that are far superior to that of conventional sucker rod guides.

The following Table I tabulates various physical properties of the ultra-high molecular weight and ultra-high density polyethylene sucker rod guide of this invention:

TABLE I

| Property | Test Method | Unit | Typ. Val. |
|---|---|---|---|
| Specific Gravity | ASTM D-792 | g/cm$^3$ | 0.94 |
| Yield Strength @ 73 F. | ASTM D-638 | p.s.i. | 3400 |
| Ultimate Tensile Strength @ 73 F. | ASTM D-638 | p.s.i. | 6800 |
| Break Elongation @ 73 F. | ASTM D-638 | % | 450 |
| Yield Strength @ 250 F. | Stress Strain Diag. | p.s.i. | 700 |
| Ultimate Tensile Strength @ 250 F. | Stress Strain Diag. | p.s.i. | 3300 |
| Break Elong. @ 250 F. | Stress Strain Diag. | % | 900 |
| Hardness- | | | |
| Rockwell "R" Scale | ASTM D-785 | — | 64 |
| Shore "D" | ASTM D-2240 | — | 67 |
| Flexural Modulus of Elasticity | Bnd/Crp/1 Min. Val. | p.s.i. | 110,000 |
| Shear Strength | ASTM D-732 | p.s.i. | 3500 |
| Izod impact + @ 23 C. | ASTM D-256A | ft lbs/in. ntch | No Break |
| − @ 140 C. | ASTM D-256A | ft lbs/in. ntch | No Break |
| Environmental Stress Cracking @ F. 50 | ASTM D-1693 MOD | hrs. | 6600 |
| Water Absorption | ASTM D-570 | — | NIL |

Figure 4:
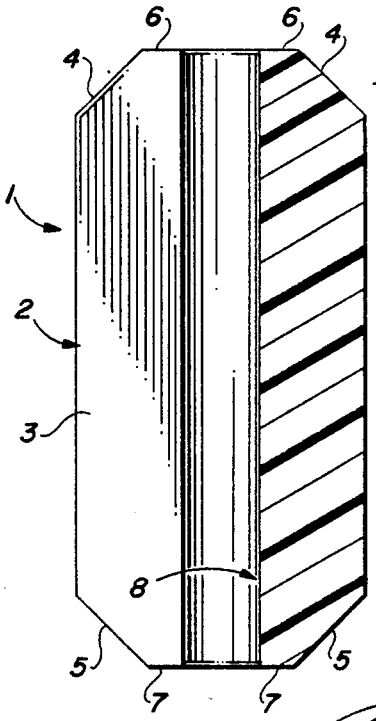
FIG. 4 is a longitudinal sectional view taken along line 4—4 of the sucker rod guide illustrated in FIG. 3.

Referring again to FIGS. 3–5 of the drawing, it will be appreciated by those skilled in the art that the centrally-located sucker rod bore 8 provided in the guide body 2 of the sucker rod guide 1 can either be drilled therein, using a special bit which inscribes the repetitive circumferential grooves 12, or the guide body 2 and the tapered body slot 9 can be extruded as round bar stock. The sucker rod bore 8 may also be extruded in the round bar stock, along with the tapered body slot 9 and a special tool can then be used to ream and inscribe the grooves 12 as desired, according to the knowledge of those skilled in the art. It will be further appreciated that the top taper 4 and the bottom taper 5 shaped in the guide body 2 to define the center body section 3 are provided in order to insure that minimal friction is created in the bore of the tubing 18 when the sucker rod guide reciprocates or spins therein responsive to reciprocating or spinning movement of the sucker rod string 13.

Referring again to FIGS. 3 and 5 of the drawing, in another most preferred embodiment of the invention the sucker rod guide 1 is mounted on a sucker rod 13*a* by placing the guide body 2 on the sucker rod 13*a* with the slot mouth 10 lying adjacent to the sucker rod 13*a*. The guide body 2 is then struck sharply with a hammer or mallet to momentarily spring the tapered body slot 9 open and force the guide body 2 onto the sucker rod 13*a*, such that the sucker rod 13*a* locates and seats in the undersized sucker rod bore 8. Accordingly, as heretofore described, the "spring" action created by the tapered body slot 9, coupled with the 1/16 inch undersize in the sucker rod bore 8 and the grooves 12, cause the guide body 2 to tightly grip the sucker rod 13*a* at the desired installed location, to minimize movement of the sucker rod guide 1 on the sucker rod 13*a*, responsive to reciprocation or spinning of the sucker rod string 13 and the sucker rod guide 1 inside the tubing 18. This "spring" action causes the slot mouth 10 of the body slot 9 to enlarge slightly when the sucker rod 13*a* is seated in the rod bore 8, such that the slot mouth 10 is substantially equal in width to that of the slot throat 11, as heretofore described.

It will be appreciated by those skilled in the art that the sucker rod guides 1 of this invention can be color-coded and constructed to fit on sucker rods 13*a* of any diameter and specification, in non-exclusive particular, as follows: for a one inch O.D. sucker rod 13a, the slot mouth 10 of the body slot 9 is 9/16 of an inch, the slot throat 11 is 11/16 of an inch and the diameter of the sucker rod bore 8 is 15/16 of an inch. Similarly, for a sucker rod 13a having a diameter of 7/8 of an inch, the slot mouth 10 is 7/16 of an inch, the slot throat 11 is 9/16 of an inch and the diameter of the sucker rod bore 8 is 13/16 of an inch. Under circumstances where the sucker rod 13a is ¾ of an inch in outside diameter, the slot mouth 10 is 5/16 of an inch, the slot throat 11 is 7/16 of an inch and the diameter of the sucker rod bore 8 is 11/16 of an inch. Furthermore, for a sucker rod 13a which is ⅝ of an inch in outside diameter, the slot mouth 10 of the body slot 9 is 3/16 of an inch, the slot throat 11 is 5/16 of an inch and the diameter of the sucker rod bore 8 is 9/16 of an inch.

The following Table II tabulates various sizes and shades of color of the sucker rod guides as a function of sucker rod and tubing size:

TABLE II

| U.H.M.W. Rod Guide Size | Tubing OD | U.H.M.W. Rod Guide OD Installed, in Inches | Rod Size | U.H.M.W. Rod Guide Color Code |
|---|---|---|---|---|
| 2" × ⅝" | 2 1/16" or 2⅜" | 1.625" | ⅝" | Green |
| 2" × ⅝" | 2⅜" | 1.875" | ⅝" | Orange |
| 2" × ¾" | 2⅜" | 1.875" | ¾" | Orange |
| 2" × ⅞" | 2⅜" | 1.875" | ⅞" | Orange |
| 2½" × ⅝" | 2⅞" | 2.125" | ⅝" | Green |
| 2½" × ¾" | 2⅞" | 2.125" | ¾" | Green |
| 2½" × ⅞" | 2⅞" | 2.125" | ⅞" | Green |
| 2½" × ¾" | 2⅞" | 2.375" | ¾" | Yellow |
| 2½" × ⅞" | 2⅞" | 2.375" | ⅞" | Yellow |
| 2½" × 1" | 2⅞" | 2.375" | 1" | Yellow |
| 3" × ¾" | 3½" | 2.625" | ¾" | Blue |
| 3" × ⅞" | 3½" | 2.625" | ⅞" | Blue |
| 3" × 1" | 3½" | 2.625" | 1" | Blue |

The sucker rod guide of this invention is characterized by a highly degree of utility, reliability and longevity, in that in a most preferred embodiment it is constructed of polyethylene having an ultra-high molecular weight of at least 2 million and more preferably, in the range of from about two million to about six million, which results in an ultra-high density and good self-lubricating and/or wet-lubricating characteristics, high abrasion resistance and toughness and the necessary resiliency to facilitate mounting on a sucker rod without shattering, deforming or moving excessively on the sucker rod. Most preferably, the ultra-high molecular weight of the polyethylene is in the range of from about 2 million to about 5 million and the polyethylene is extruded into bar stock for ease of manufacture. Furthermore, the sucker rod guide of this invention can be constructed to any desired specifications for fitting on a sucker rod of any selected outside diameter and is quickly and easily installed on the sucker rod using conventional tools and equipment. Moreover, while the sucker rod guide is most preferably constructed of extruded bar stock having the requisite ultra-high molecular weight, it will be appreciated that other molding techniques, including compression-molding and injection-molding procedures, in non-exclusive particular, which produce an ultra-high density product of desired specifications, can also be used. Furthermore, techniques for injection-molding or compression-molding the ultra-high density sucker rod guide detailed herein directly on the sucker rod itself, can also be used without departing from the spirit and scope of the invention. Accordingly, while the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A sucker rod guide for mounting on a sucker rod comprising a generally cylindrically-shaped cylinder shape from polyethylene having an ultra high molecular weight in the range from about two million to about five million; a longitudinal bore provided in said cylinder, wherein said bore is smaller in diameter than the diameter of the sucker rod; a tapered slot extending through said cylinder in longitudinal relationship, said tapered slot communicating with said bore and further comprising a slot mouth having having a first spacing and a slot throat spaced from said slot mouth, said slot throat lying adjacent to said sucker rod bore and having a second spacing and wherein said second spacing is wider than said first spacing, for mounting said sucker rod guide on the sucker rod; a first taper terminating one end of said cylinder and a second taper terminating the opposite end of said cylinder; and a plurality of grooves provided in spaced circumferential relationship in said bore.

2. The sucker rod guide of claim 1 wherein said polyethylene is extruded to shape said cylinder.

3. A sucker rod guide for mounting on a sucker rod and spacing the sucker rod from the tubing in an oil well, comprising a generally cylindrically-shaped, ultra-high molecular weight, extruded polyethylene body having a substantially smooth outside surface, said ultra-high molecular weight being in the range of from about two million to about five million; a longitudinal bore provided centrally in said body, said bore being smaller in diameter than the diameter of the sucker rod; a plurality of grooves provided in spaced, circumferential relationship in said bore; and a tapered slot extending longitudinally through said body from said outside surface to said bore, said tapered slot further comprising a slot mouth located at said outside surface and a slot throat spaced from said slot mouth, said slot throat lying adjacent to said sucker rod bore and wherein said slot throat is wider than said slot mouth for mounting said sucker rod guide on the sucker rod.

4. The sucker rod guide of claim 3 further comprising a first taper terminating one end of said body and a second taper terminating the opposite end of said body.

5. A sucker rod guide for mounting on a sucker rod and spacing the sucker rod from the tubing in an oil well, comprising a generally cylindrically-shaped, extruded polyethylene body having an ultra-high molecular weight in the range of from about two million to about five million, an ultra-high density and a substantially smooth outside surface; a longitudinal bore extending centrally through the length of said body, said bore being smaller in diameter than the diameter of the sucker rod and a plurality of grooves provided in circumferential relationship in said bore; and a tapered slot extending longitudinally through said body from a first width at said outside surface to a second width at said bore, said first width normally being more narrow than said second width when said sucker rod guide is not mounted on the sucker rod, for mounting said sucker rod guide on the sucker rod.

* * * * *